United States Patent [19]

Kurata et al.

[11] 3,959,465

[45] May 25, 1976

[54] PROCESS FOR PREPARING CONCENTRATED TITANIUM MINERAL

[75] Inventors: Tokuzo Kurata; Satoshi Emi; Kunihiko Ofuchi; Tsutomu Takeuchi; Isamu Sone, all of Kitakyushu, Japan

[73] Assignee: Mitsubishi Chemical Industries Ltd., Tokyo, Japan

[22] Filed: May 24, 1974

[21] Appl. No.: 473,083

[30] Foreign Application Priority Data

May 25, 1973 Japan ..... 48-58398

[52] U.S. Cl. ..... 423/86; 423/74; 75/101 R; 423/610

[51] Int. Cl.[2] ..... C01G 23/04; B01D 11/02; C22B 1/00

[58] Field of Search ..... 423/86, 74, 610; 75/101 R

[56] References Cited

UNITED STATES PATENTS

| | | | |
|---|---|---|---|
| 1,885,187 | 11/1932 | De Rohden | 423/86 |
| 2,127,247 | 8/1938 | Dawson et al. | 423/86 |
| 2,133,251 | 10/1938 | McCord | 423/610 X |
| 2,406,577 | 8/1946 | Alessandroni et al. | 423/86 |
| 2,464,192 | 3/1949 | Whately | 423/610 |
| 2,804,375 | 8/1957 | Kamlet | 423/86 |
| 2,912,320 | 11/1959 | Chang | 423/74 X |
| 3,281,268 | 10/1966 | Martin | 75/101 R |
| 3,627,508 | 12/1971 | Hughes et al. | 423/86 X |
| 3,660,029 | 5/1972 | Naguib | 75/101 R X |
| 3,660,078 | 5/1972 | Yamada et al. | 75/101 R |
| 3,777,013 | 12/1973 | Soverini et al. | 75/101 R X |

OTHER PUBLICATIONS

"Fluidization," by Donald F. Othmer, 1956 Ed., pp. 4 and 55, Reinhold Pub. Corp., New York.

*Primary Examiner*—Edward Stern
*Attorney, Agent, or Firm*—Oblon, Fisher, Spivak, McClelland & Maier

[57] ABSTRACT

Titanium minerals are concentrated by leaching with an acid leaching agent in the presence of a chelating agent, sulfonate surfactant or polyacrylamide surfactant, wherein the iron components are removed from the minerals.

5 Claims, 1 Drawing Figure

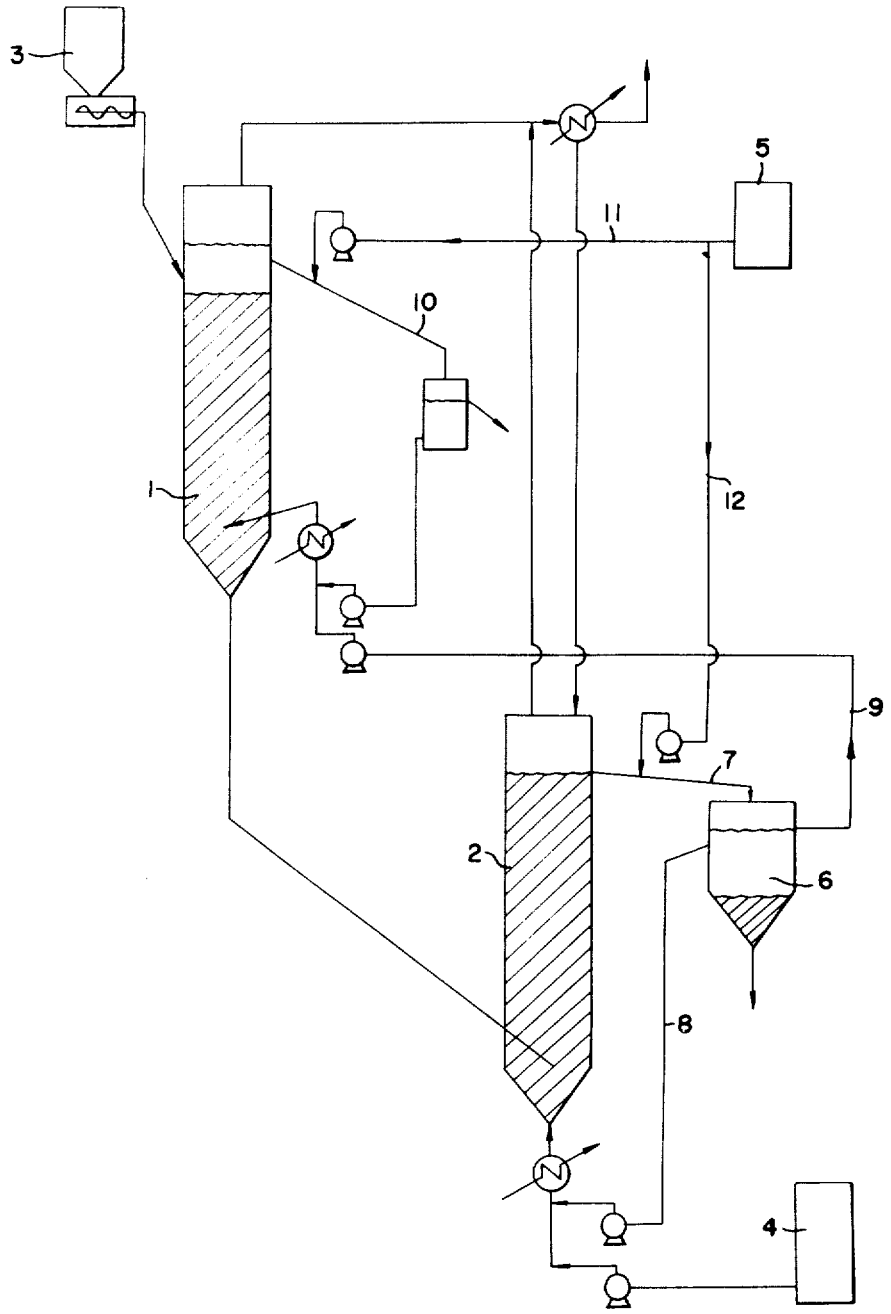
3
5
11
10
1
12
9
7
2
6
8
4

PROCESS FOR PREPARING CONCENTRATED TITANIUM MINERAL

BACKGROUND OF THE INVENTION

1. Field of the Invention

The present invention relates to a process for preparing concentrated titanium minerals. More particularly, the invention relates to an improved process for preparing concentrated titanium minerals by leaching with an acid leaching agent to separate the iron components.

2. Description of the Prior Art

Titanium minerals are useful as raw materials for titanium dioxide. Thus, the preferable raw materials are the concentrated titanium minerals having high titanium content (for example, containing more than 90% by weight of $TiO_2$) prepared by removing the iron components which are present in large amounts in the titanium minerals.

Oxidative thermal decomposition of tetrachlorotitanium, prepared by chlorinating a concentrated titanium mineral in a fluidized bed, has been effectively used for the preparation of titanium dioxide from the concentrated titanium mineral. In this method, if fine particles are contained in the concentrated titanium mineral fed at the chlorination stage, the fine particles will be carried along unreacted or incompletely reacted with the flow gas discharged from the reactor, resulting in loss of material, and transport difficulties, such as pipe clogging. Accordingly, fine particles are preferably omitted from the concentrated titanium mineral.

It is known that titanium minerals may be reduced and leached with acids, such as hydrochloric acid, to separate the iron components and thus prepare concentrated titanium minerals. However, by conventional processes, it is difficult to prevent the formation of large amounts of fine particles, especially particles having diameters of less than 10$\mu$. Therefore, this method is clearly undesirable.

In the prior art concentrating procedure, the formation of a hard scale by deposition of a precipitate containing mainly $TiO_2$ on the inner surface of the pipe connected to the leaching apparatus has been a serious problem during long term operation.

A need exists therefore for a method of concentrating titanium minerals by leaching, which will eliminate the formation of fine particles and inhibit scaling on the surfaces of the apparatus.

SUMMARY OF THE INVENTION

Accordingly, one object of the present invention is to provide a process for preparing a concentrated titanium mineral containing few fine particles, from a titanium mineral, while inhibiting scaling on the surface of the apparatus.

These and other objects as will hereinafter become more readily understood by the following description can be attained by leaching a titanium mineral with an acid leaching agent so as to separate the iron components, in the presence of at least one additive selected from the group consisting of chelating agents, sulfonate surfactants and polyacrylamide coagulants.

DETAILED DESCRIPTION OF THE PREFERRED EMBODIMENTS

In the process of the invention, suitable titanium minerals include ilmenite and other natural titanium minerals containing chromium silicate, or other minerals, having particle diameters of 50–400$\mu$.

The titanium mineral is preferably oxidized at a high temperature, e.g., 800°–1000°C, with oxygen or an oxygen-containing gas, and then reduced at 700°–1000°C, preferably 750°–900°C, with a reducing agent, such as a reducing gas, e.g., hydrogen, CO, hydrocarbon gas, or a mixture thereof, or a reducing solid, e.g., carbon, raw coke coal, coal, or the like, before the leaching treatment to increase the rate of separation of the iron components and to obtain a concentrated titanium mineral containing small amounts of fine particles. The titanium mineral may also be reduced without any oxidizing treatment.

Suitable chelating agents include polyaminocarboxylic acids, such as ethylenediametetraacetic acid, nitrilotriacetic acid, nitrilotripropionic acid, iminodiacetic acid, iminodipropionic acid, cyclohexadiaminetetraacetic acid; polyaminocarboxylic amides, such as nitrilotriacetic amide, nitrilotripropionic amide, iminodiacetic amide, iminodipropionic amide; polyaminonitriles, such as nitrilotriacetic nitrile, nitrilotripropionitrile, iminodiacetic nitrile, iminodipropionitrile; polycarboxylic acids, such as oxalic acid, malonic acid, succinic acid, adipic acid; oxycarboxylic acids, such as tartaric acid, citric acid; and condensed phosphoric acids, such as tripolyphosphate, tetrapolyphosphate, hexametaphosphate or the like.

Suitable sulfonate surfactants include alkylbenzenesulfonates, such as Na-dodecylbenzenesulfonate, tetradecylbenzenesulfonate; alkylnaphthalenesulfonates such as dodecylbenzenenaphthalenesulfonate, tetradecylnaphthalenesulfonate; alkylsulfates, such as dodecylsulfate, tetradecylsulfate; $\alpha$-sulfoaliphatic alkyl esters, such as Na-decyl $\alpha$-sulfobutyrate, Na-dodecyl $\alpha$-sulfopropionate, Na-hexyl $\alpha$-sulfopelargonate; succinic dialkyl ester sulfonates, such as Na-succinic di-n-amylester sulfonate, Na-succinic monoethyl monododecyl ester sulfonate; and amidosulfonates, such as N-hexadecanoyl-N-methyltaurate. The chelating agents and the sulfonate surfactants may be used in the form of the free acid or metal salt, e.g., potassium salt, sodium salt, ammonium salt, etc.

Suitable polyacrylamide coagulants include nonionic, cationic or anionic polyacrylamide coagulants. A suitable coagulant has a molecular weight of from several thousand to several million. Nonionic polyacrylamides have no free carboxyl groups. Anionic polyacrylamides have no free carboxyl groups. Anionic polyacylamides have carboxyl groups present to the extent of 1–30% of total acrylamide units. Cationic polyacrylamides have quaternary amino groups present to the extent of 1–30% of total acrylamide units. The free carboxyl groups and quaternary amino groups may be formed in the conventional manner.

A modified polyacrylamide containing from 1 to about 80% of free amino groups or amido bonds is also suitable. Various coagulants sold under the name of Diaclear (Mitsubishi Chemical Ind. Co.) or other commercially available polyacrylamide coagulants are likewise suitable.

Two or more additives may be combined. The polyacrylamide coagulant is preferably included among the additives because of the ability of that coagulant to inhibit scaling in the apparatus. The quantity of additive employed depends upon the type of the titanium mineral, type and concentration of the acids, and condition of the leaching treatment, and is preferably used in a quantity of 0.001 – 5.0% by weight of the titanium mineral. The quantity of the chelating agent or the sulfonate surfactant, is preferably from 0.01 to 5.0% by weight. The quantity of the polyacrylamide coagulant is preferably from 0.001 to 1.0%, preferably from 0.001 to 0.2%.

Suitable methods of incorporating the additives in the leaching treatment system include direct addition into the leaching treatment system, impregnation of the additive into the titanium mineral, or admixture of the additives with the acid leaching agent. The additive may be added in the separate steps of a multi-stage leaching process.

Suitable acid leaching agents include hydrochloric acid, sulfuric acid, or other mineral acids. In general, hydrochloric acid is preferable. The hydrochloric acid can be combined with ferrous chloride or other metal chlorides. The hydrochloric acid is usually used at a concentration of 5–36%, preferably 10–36% by weight. The acid is usually supplied to the leaching apparatus after preparing a desirable concentration outside of the leaching apparatus. It is also possible to introduce hydrogen chloride gas into the leaching apparatus and thus prepare a desirable concentration of hydrochloric acid inside the apparatus.

The leaching treatment can be carried out at higher than 80°C, preferably higher than 100°C and lower than the boiling point of the mixture, under reduced pressure up to several kg/cm$^2$ by a batch system or by a continuous system. The leaching method is preferably conducted as a continuous system since as such, the scaling inhibition is highest. The leaching time depends upon the particle size of the titanium mineral, temperature in the treatment, concentration of the leaching agent, and mode of operation (batch or continuous) and is preferably about 2–50 hours.

The leaching mixture is preferably fed to a conventional separator, such as a filter, a centrifugal separator, a sedimentation separator, or the like to separate the mother liquor from the concentrated titanium mineral containing more than 90% $TiO_2$. When the leaching treatment is carried out in a batch system, the separation can be effected directly in the leaching apparatus. The resulting concentrated titanium mineral is washed, dried and calcined to prepare the mineral for chlorination in a fluidized bed. In accordance with the invention, adding a small amount of the additive inhibits the formation of fine particles, and scaling in the leaching apparatus or the leaching system, such as pipes connected to apparatus, can be inhibited or decreased. The scale may be easily removed by washing with water. Accordingly, the process of the invention is quite advantageous as an industrial process for preparing concentrated titanium minerals.

A further understanding can be attained by reference to certain specific Examples which are provided herein for purposes of illustration only and are not intended to be limiting in any manner, unless otherwise specified.

BRIEF DESCRIPTION OF THE DRAWING

The drawing is a flow sheet showing the leaching apparatus employed in Examples 1 and 2 of the invention.

EXAMPLE 1

A titanium mineral composed of 54.3% $TiO_2$, 23.7% FeO and 16.9% $Fe_2O_3$, which had an average particle diameter of 150$\mu$ and was produced in the Western part of Australia, was oxidized in a fluidized bed reactor maintained at 950°C for 60 minutes using an oxidizing agent and air as flow gas.

The product was reduced in a fluidized bed reactor maintained at 850°C by introducing hydrogen gas containing 10% moisture for 30 minutes. The treated titanium mineral was cooled to room temperature in an inert gas, and the iron components in the treated mineral were analyzed. Of the total iron components, 85.4% were in the form of ferrous compounds.

The reduced titanium mineral was leached using a continuous leaching apparatus shown in the drawing. The mineral was fed from the storage chamber 3 to the first leaching tower 1 at a rate of 100 parts by weight/hour so as to contact the mineral with hydrochloric acid in the tower for 4 hours. The treated mineral was then fed to the second leaching tower 2 and leached for 2.5 hours. 24% hydrochloric acid leaching agent heated higher than 105°C was continuously fed at a rate of 269 parts by weight per hour from a hydrochloric acid tank 4 to the second leaching tower 2 (at a rate of rising of the level of the leaching agent of 0.15 cm/sec in the tower). The linear velocity of the leaching agent was thus maintained at 0.15 cm/sec in the tower. The leaching mixture containing the concentrated titanium mineral was discharged from pipe 7 at a rate of 58 parts by weight/hour, and was fed to a separator 6 wherein the mixture was separated into a hydrochloric acid component and the treated mineral component. A part of the recovered hydrochloric acid component was recycled to the second leaching tower 2 and the remainder was fed to the first leaching tower 1 (at a rate of rising of the level of the leaching agent of 0.15 cm/sec in the tower). (The linear velocity of the leaching agent was maintained at 0.15 cm/sec in the tower). In the first leaching tower 1, the hydrochloric acid component was recycled through the pipe 10.

A 0.1% aqueous solution of an anionic polyacrylamide additive was continuously fed from a storage tank 5 through pipes 11 and 12 to the pipes 10 and 7 at a rate of 4 parts by weight/hour. When the system was in a steady state, the percentage of fine particles (less than 10$\mu$ in diameter) in the concentrated titanium mineral was measured, and the Ti component and Fe component in the concentrated titanium mineral were also measured. As a reference, the result of the treatment without the additive were also measured. The results are shown in Table 1.

TABLE 1

| | Composition of concentrated titanium mineral | | Percentage of fine particles in total product (weight %) |
|---|---|---|---|
| | $TiO_2$ | Fe content | |
| Example 1 | 94.0% | 2.3% | 0.5% |
| Reference | 93.8% | 2.5% | 0.9% |

As is clear from the results, the formation of five particles was remarkably lower by employing the process of the invention. The leaching treatment was continued for 10 days, in both cases. In the Reference, solid material was deposited in the separator 6, in the heat-exchanger or on various pipes in a maximum thickness of 10 mm and was difficulty removed. On the contrary, in accordance with the process of the invention, the deposited solid was minimal and could be easily removed.

EXAMPLE 2

The process of Example 1 was repeated and the leaching treatment of the titanium mineral was continuously carried out for 5 days, except that 0.05 parts by weight/hour of 9% phosphoric acid or 4 parts by weight/hour of a 0.1% aqueous solution of Na-dodecylbenzenesulfonate was used instead of 4 parts by weight/hour of the 0.1% aqueous solution of the anionic polyacrylamide. In the system, a slight amount of deposited solid was noted, but was easily removed.

EXAMPLE 3

A titanium mineral composed of 55% $TiO_2$, 24% FeO, 17% $Fe_2O_3$, which had an average particle diameter of 150$\mu$ and was produced in the Eastern coast of Australia, was oxidized in a fluidized bed reactor maintained at 900°C for 60 minutes, using air as flow gas. The product was reduced in a fluidized bed reactor maintained at 850°C by introducing hydrogen gas containing 10% moisture for 60 minutes. 400 parts by weight of the reduced titanium mineral were fed to a leaching vessel equipped with a stirrer, and 1200 parts by weight of 20% hydrochloric acid and an additive shown in Table 2 were added to leach at 105° – 109°C under atmospheric pressure for 5 hours with stirring. The product was washed with water and dried to obtain a concentrated titanium mineral. The percentage of fine particles, having diameter less than 10$\mu$, formed in the leaching treatment was measured. The results are shown in Table 2. As a reference, the leaching treatment was repeated without using an additive. The results are shown under Experiment 1.

TABLE 2

| Experiment No. | Additive Type | Amount (weight part) | Percentage of fine particles in total $TiO_2$ (weight %) |
|---|---|---|---|
| 1 | None | — | 4.8 |
| 2 | oxalic acid | 4.0 | 1.6 |
| 3 | tartaric acid | 4.0 | 2.1 |
| 4 | Na-nitrilotripropionate | 4.0 | 1.9 |
| 5 | ethylenediaminetetra-acetate (2-Na salt) | 4.0 | 1.0 |
| 6 | Na-dodecylbenzene sulfonate | 0.4 | 2.5 |
| 7 | $H_3PO_4$ | 0.4 | 2.5 |
| 8 | anionic type polyacrylamide | 0.04 | 2.8 |
| 9 | nonionic type polyacrylamide | 0.04 | 3.0 |
| 10 | cationic type polyacrylamide | 0.04 | 3.3 |

EXAMPLE 4

A titanium mineral composed of 54.3% $TiO_2$, 23.7% FeO and 16.9% $Fe_2O_3$, which had an average particle diameter of 150$\mu$ and was produced in the Western part of Australia, was oxidized in a fluidized bed reactor maintained at 950°C for 1 hour using air as flow gas. The product was reduced in a fluidized bed reactor maintained at 850°C by introducing hydrogen gas containing 10% moisture for 30 minutes. The treated titanium mineral was cooled to room temperature in an inert gas, and the iron components in the treated mineral were analyzed. Of the total iron components 95.4% were in the form of ferrous compounds.

The reduced titanium mineral was fed to the top of the first cylindrical leaching tower at a rate of 100 parts by weight/hour and hydrochloric acid discharged from the second leaching tower was fed to the bottom of the first leaching tower (at a rate of rising of the level of leaching agent of 0.20 cm/sec in the tower). A linear velocity of the leaching agent in the tower was maintained at 0.20 cm/sec by recycling a part of the leaching agent which was discharged from the first leaching tower. The temperature of the hydrochloric acid leaching agent was maintained at higher than 105°C. The mineral was retained and leached in the first leaching apparatus for four hours. The treated mineral was then fed to the vicinity of the bottom of the second cylindrical leaching tower and was retained for 2.5 hours in the second cylindrical leaching tower. 24% hydrochloric acid was fed to the bottom of the second leaching tower at a rate of 243 parts by weight per hour. The conditions in the second leaching tower were the same as those of the first leaching tower. In this two-stage continuous leaching treatment 0.1% by weight of an anionic polyacrylamide solution was fed to each of the leaching towers at a rate of 12 parts by weight/hour. The percentage of fine particles, with diameter less than 10$\mu$, formed in the leaching treatment was measured. The results are shown in Table 3.

TABLE 3

| | Composition of concentrated titanium mineral | | Percentage of fine particles in total $TiO_2$ (weight %) |
|---|---|---|---|
| | $TiO_2$ | Fe content | |
| Example 3 | 93.5% | 2.6% | 0.5% |
| Reference | 93.2% | 2.8% | 1.1% |

As is clear from the results, the formation of fine particles was inhibited by the additive. The leaching treatment was continued for 3 days. The quantity of scale desposited in the leaching tower and pipes was quite low. On the contrary, when the additive was not employed, scale was deposited with a maximum thickness of 10 mm.

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. In a process for preparing concentrated titanium materials by reducing a titanium mineral of partical sizes ranging from 50 – 400 microns with a reducing agent such that the iron components of the mineral are substantially reduced to the $Fe^{+2}$ state, and thereafter leaching said reduced titanium mineral with an acid leaching agent, the improvement which comprises:

leaching said reduced titanium mineral at a temperature of at least 80°C, but less than the boiling point of the leaching mixture in the presence of from 0.001 – 5.0% based on the weight of said titanium mineral with at least one polyacrylamide coagulant, whereby the formation of fine particles with a diameter less than 10$\mu$ of the titanium mineral is inhibited, and the formation of hard scale by deposition of a precipitate containing mainly $TiO_2$ is prevented.

2. The process of claim 1, wherein hydrochloric acid is used as the acid leaching agent.

3. The process of claim 1, wherein the leaching treatment is carried out in a fluidized state.

4. The process of claim 1 wherein the titanium mineral is ilmenite.

5. The process of claim 4, wherein the ilmenite is leached after successive oxidizing and reducing treatments.

* * * * *